United States Patent [19]

Ullman

[11] Patent Number: 5,033,244

[45] Date of Patent: Jul. 23, 1991

[54] CORNER ASSEMBLY FOR FLUSH FITTING PROTECTIVE STRIP ASSEMBLY

[75] Inventor: Myron Ullman, Canfield, Ohio

[73] Assignee: Boston Metal Products Corp., Medford, Mass.

[21] Appl. No.: 383,763

[22] Filed: Jul. 21, 1989

[51] Int. Cl.[5] ..... E04F 19/02

[52] U.S. Cl. ..... 52/288; 52/829

[58] Field of Search ..... 403/295, 402, 403; 52/783, 822, 287, 288, 280, 282, 829; 248/345.1

[56] References Cited

U.S. PATENT DOCUMENTS

| | | | |
|---|---|---|---|
| 1,250,594 | 12/1917 | Knapp | 52/287 |
| 1,822,032 | 9/1931 | Hunter | 52/829 |
| 2,263,204 | 11/1941 | Clark | 52/822 |
| 2,635,935 | 4/1953 | Andersen | 52/783 |
| 3,645,569 | 2/1972 | Reilly | 403/295 |
| 3,836,043 | 9/1974 | Levin | 248/345.1 |
| 4,083,592 | 4/1978 | Rubin et al. . | |
| 4,303,289 | 12/1981 | Hardy | 403/295 |
| 4,700,959 | 10/1987 | Lars | 403/403 |
| 4,808,451 | 2/1989 | McCue | 428/31 |

*Primary Examiner*—James L. Ridgill, Jr.
*Attorney, Agent, or Firm*—Hale and Dorr

[57] ABSTRACT

The invention is a corner assembly for use with a flush fitting protective strip bumper comprising a corner piece having an elongate mounting portion which terminates in a head portion, having a receptacle and an adaptor piece having an elongate mounting portion, which terminates in a corner engagement portion having a tongue wherein said tongue pivotably positively engages with the receptacle. In a preferred embodiment, the elongate mounting portions of each the corner piece and the adaptor comprise a pair of channels, each channel having a pair of discontinuous channel surfaces, each surface staggered with respect to the other surface of the pair, wherein the channels extend symmetrically form opposite sides of the body portion.

8 Claims, 5 Drawing Sheets

CORNER ASSEMBLY FOR FLUSH FITTING PROTECTIVE STRIP ASSEMBLY

BACKGROUND OF THE INVENTION

This invention relates generally to protective bumper strip assemblies and more particularly, to corner assembly for said protective strips for protecting furniture edges, wall and display case surfaces and the like. Protective strip assemblies using resilient strip materials in various types of channels are known in the art, as illustrated in U.S. Pat. Nos. 4,083,592 and 4,808,451 and the patents cited therein, both of which are incorporated herein by reference. The protective strip assembly disclosed in the patents includes a metal channel capped by a strip of a resilient material, such as rubber, or vinyl. The channel, which may be roughly rectangular in its outside cross-section, attaches to a surface to be protected.

The invention is used with flush fitting protective strip assemblies of the prior art, as shown in FIGS. 1 and 2, which features a mounting member 10 and an elongated strip 12 of resilient material. Strip 12, a semi-cylindrical body, is secured in and partially surrounds the mounting member 10. As shown in FIGS. 1 and 2, when installed, the protective strip fits flush against the edge of the surface to be protected. The mounting member 10 is not visible once the assembly is installed. The resilient strip also includes a pair of radially-inwardly extending latch members 16, each extending longitudinally of the strip 12. The mounting member 10 includes a web portion 18 having a pair of oppositely disposed web-latch extensions 20 and two leg members 22 extending from the web portion 18 away from the semi-cylindrical body. A pair or oppositely disposed base members 24, each extend from a leg member 22, away from each other and each terminate in a base latch portion 26. Each of the pair of web latch extensions and each of the pair of base latch portions mates with the semi-cylindrical body adjacent the radial latch member. The resilient strip 12 is thus positively engaged with the mounting member 10. The invention is also suitable for use with a resilient strip having solid, radially projecting latch members, with a terminal hook, described fully in U.S. Pat. Application No. 383,905, entitled "Improved Resilient Strip and Mounting Member for Flush Fitting Protective Strip Assembly", filed in the name of Gerald Kessler concurrently herewith, which is hereby incorporated by reference herein.

The present invention relates to a corner assembly for flush fitting protective strips. As will be understood with reference to FIG. 2, additional elements to the mounting members 10 and resilient strip 12 are necessary to provide a smooth surface around a corner. A known device of the prior art uses a corner piece 30 and an adaptor 32. Two of each are shown in FIG. 2, one pair engaged with each other, and the other disengaged. The adaptor 32 engages the corner 30 by means of tang 34. Tang 34 engages a receptacle in corner 30 (not shown) of a similarly rectangular box shape. The corner 30 and adaptor 32 are engaged only by the friction fit of tang 34 within the receptacle. The assembled corner-/adaptor unit engages the assembled channel/ resilient member unit by means of tang 36 of corner 30 and tang 38 of adaptor 32. The tangs are identical and of a size and shape to fit within cavity 40, formed between legs 22 of mounting member 10 and the surface 14 being protected. Additional lugs 42 also fit between web 18 and the inside surface of resilient member 12.

Each of the above mentioned engagements is a friction fit. It is possible to secure corner 30 and adaptor 32 to surface 14 by means of a screw through tangs 36 and 38. However, this is a rather time consuming operation, because it must be done when resilient strip member 12 is either removed or pulled back. Further, the corner assembly appears to be complete when assembled, and will not fall off, even without the screws. Consequently, those installing the protective strip and mounting channel assembly often neglect to secure the corner 30 and adaptor 32 by this positive screw means. Consequently, the only force retaining the corner and adaptor in place is friction. It will be understood to one of ordinary skill in the art that the corners are often banged and jostled by moving carts, people etc. and the friction forces are inadequate to maintain the corner/adaptor assembly in place.

The corner assembly of the prior art is also prone to disengagement due to the friction only mode of engagement between the tang 34 of adaptor 32 and the receptacle of corner 30. Because friction is the only retention force, if the corner 30 is not retained by a screw or other positive means, such as a tack, into the surface 14, it can be bumped off separately from the adaptor 32.

Another drawback of the known corner assembly relates to the elastic nature of the resilient protective strip 12. Typically, this protective strip is made from vinyl. As the vinyl covering is installed, it tends to stretch due to the handling and pulling by the workmen. Over the course of a short period of time, on the order of a week, the vinyl shrinks back to its original length. Over the course of longer periods of time, the vinyl will shrink an additional amount, to a much smaller degree due to ageing. It is useful to secure the vinyl at its terminal portions to a mounting member, to resist the shrinkage of the vinyl. According to the prior art, the end portions of the vinyl strip 12 engage the mounting member 10, which is typically of aluminum or other metal. While certain glues and cements do exist for securing vinyl to metal, it is a rather difficult process to insure a sturdy connection.

Thus, the several objects of the invention include: to provide a corner assembly for a flush fitting protective strip assembly that may be economically positively engaged to the surface to be protected; to provide a corner assembly that is made of components that may be positively engaged to each other to avoid separation; to provide a corner assembly that will facilitate securing of an elongated resilient strip to the corner assembly by epoxy or other adhesive means; to provide a corner assembly that may be economically molded from vinyl, and, to provide a corner assembly that can be easily installed.

SUMMARY OF THE INVENTION

A preferred embodiment of the invention features a two-piece corner assembly, of a corner piece and an adaptor. Each piece has a virtually identical mounting portion, provided with a set of colinear latch members for engaging a resilient strip of the type shown in FIG. 1 at 12. The corner piece and the adaptor are each shaped so that they positively engage each other upon assembly. The corner piece has a slotted quarter spherical head portion adjoining the mounting portion. The adaptor has a head portion with a curved tongue, of a size and shape to fit within the slot of the head on the corner section. The terminal portions of the tongue and the deepest most recess of the receptacle are congruently shaped to provide a positive engagement achieved upon the resilient locking of the fully inserted tongue into the head. The mounting member portions of each the corner and the adaptor are provided with holes for attaching each to the surface to be protected with screws, tacks or other suitable means.

According to an additional embodiment of the invention, the mounting portions of the corner assembly have discontinuous latch members with a relief channel between the co-linear latch members. This facilitates manufacture of the parts by a two-piece mold. Without the discontinuity and the recessed channels, it would not be possible to mold the piece and then easily remove the molded piece from the mold.

DETAILED DESCRIPTION OF THE PREFERRED EMBODIMENTS OF THE INVENTION

Figure 1:
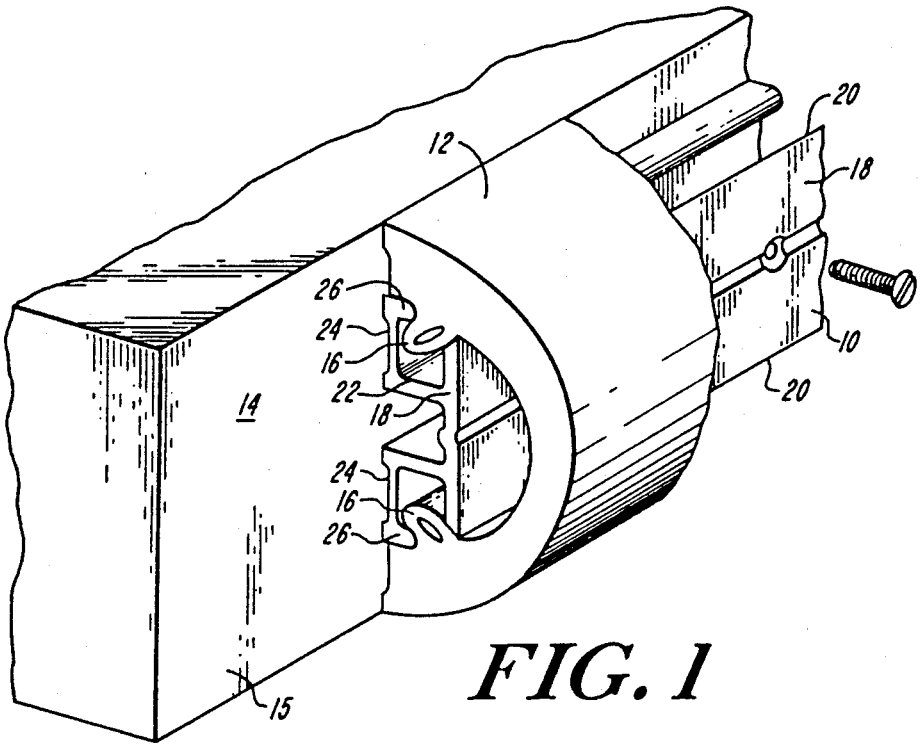
FIG. 1 is a perspective view of a portion of a combined resilient strip and mounting member assembly, as installed to be used with the corner assembly of the invention, with some portions of the resilient strip removed.

Referring now to FIG. 1, an assembly of a mounting member 10 and a resilient strip 12 is shown mounted to a surface 14 in a manner consistent with use of the claimed invention. It will be understood that for clarity the terminal portion of the resilient strip 12 has been removed from the illustration of FIG. 1. However, in actual use, it would extend beyond the length of the mounting member 10, to extend to the end of the surface 15 being protected.

Figure 6:
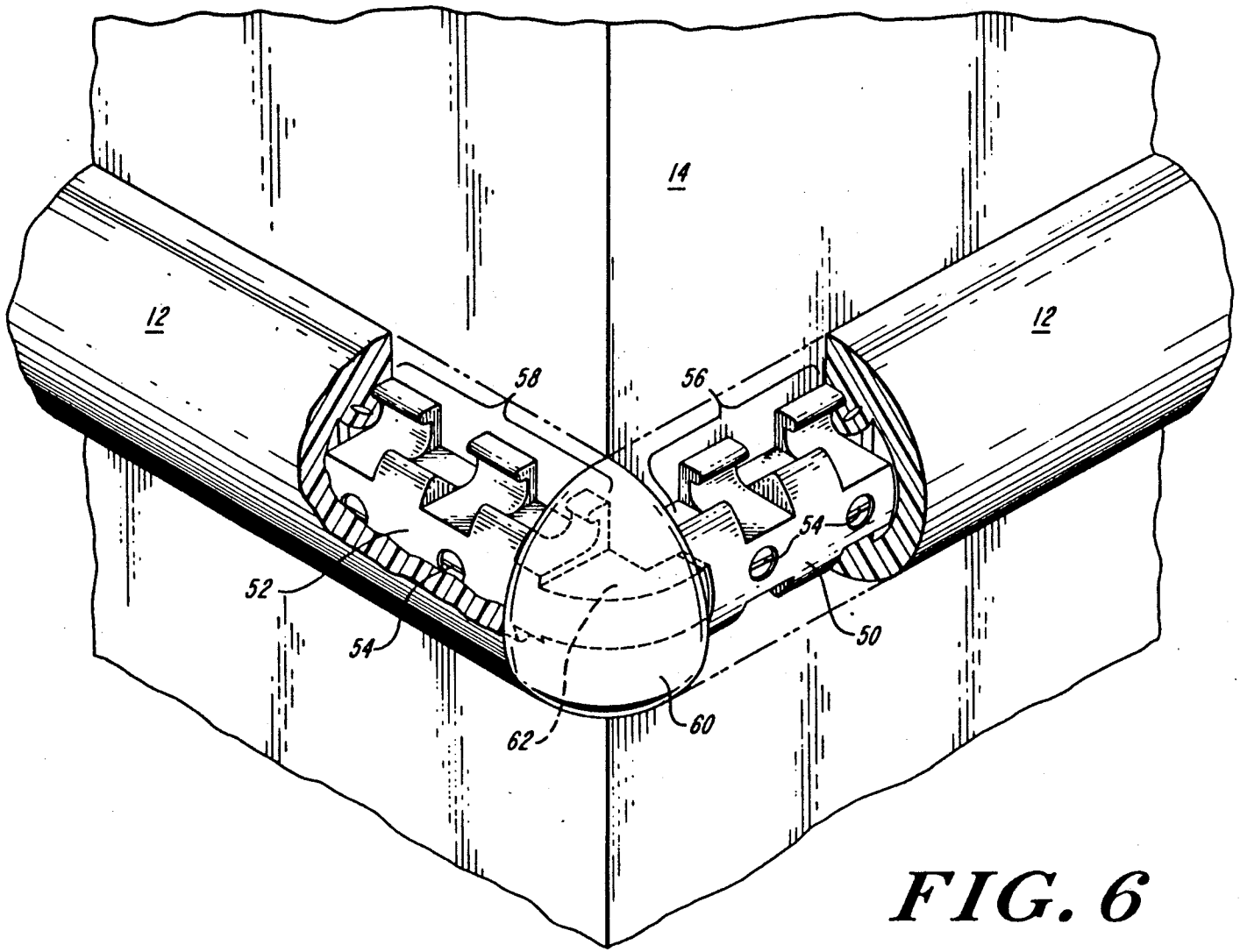
FIG. 6 is a perspective view of an assembled corner assembly with portions of the resilient members removed and portions of the corner assembly shown in phantom.

FIG. 6 shows a corner assembly of the invention, assembled and in place, with a portion of the left hand resilient strip 12 removed, and a portion of the right hand resilient strip 12 not shown for clarity. As shown in FIG. 6, the corner assembly is made up of corner piece 50 and adaptor 52. Each are secured to the surface to be protected 14 by means of screws 54. Each also includes a mounting portion 56, 58 and a head portion 60, 62. The mounting portions 56, 58 butt up against the end of the elongated channel mounting member 10 (FIG. 1). The resilient strip member 12 extends over the mounting portion 58, 56. In FIG. 6, a portion of the resilient strip 12, which extends over mounting portion 58 has been removed and the entire portion of resilient strip 12 that extends over mounting portion 56 is not shown.

Figure 3A:
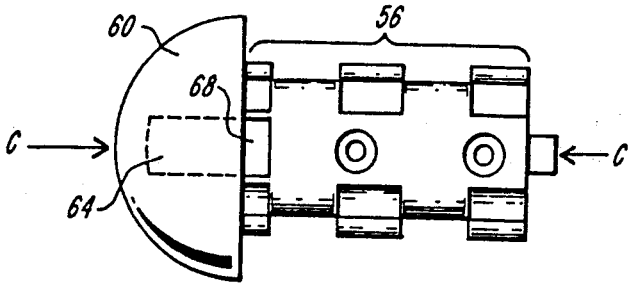
FIG. 3A is a top plan view of the corner piece shown in FIG. 3.
Figure 3B:
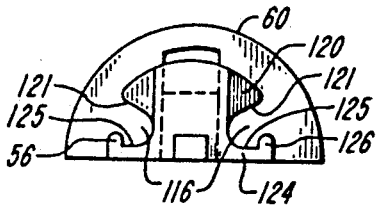
FIG. 3B is an elevation view shown from the mounting member end of the corner piece shown in FIG. 3.
Figure 3C:
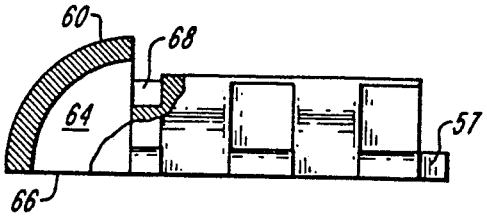
FIG. 3C is a side elevation view of the corner piece of FIG. 3, with the head portion shown in partial cross-section along the lines C shown in FIG. 3A.
Figure 3:
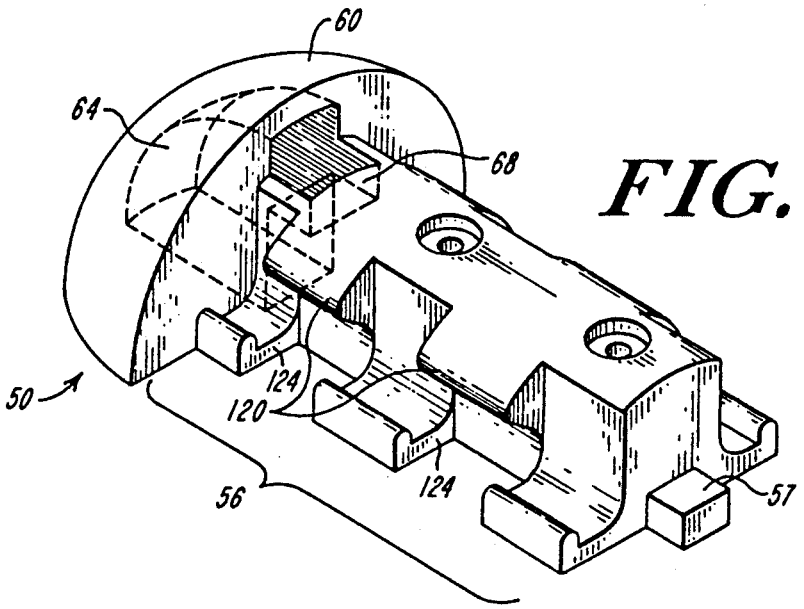
FIG. 3 is a perspective view of a corner piece of the claimed invention.
Figure 3D:
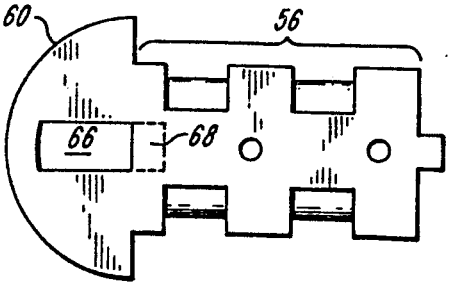
FIG. 3D is a bottom plan view of the corner piece shown in FIG. 3.

Referring now to FIG. 3, the structure of the corner member 50 will be reviewed. Corner member 50 includes a mounting portion 56, indicated generally within the braces, and quarter spherical head portion 60. Head portion 60 is provided with a hollow receptacle 64, shown in phantom, roughly in the shape of quarter of a disc or flat cylinder. Extending beyond the quarter cylinder at the portion of the receptacle most distant from its orifice 66 is a hollow lock extension 68.

Figure 4A:
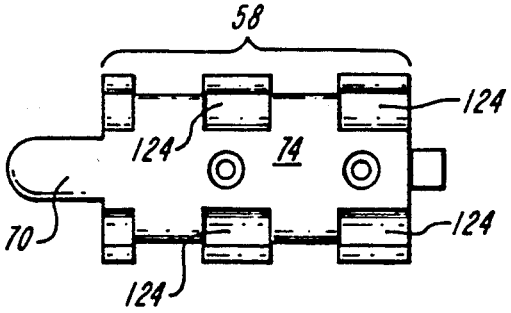
FIG. 4A is a top plan view of the adaptor shown in FIG. 4.
Figure 4B:
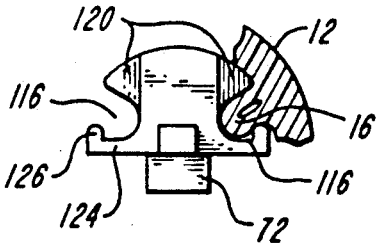
FIG. 4B is a end elevation view, from the mounting member and of the adaptor shown in FIG. 4.
Figure 4C:
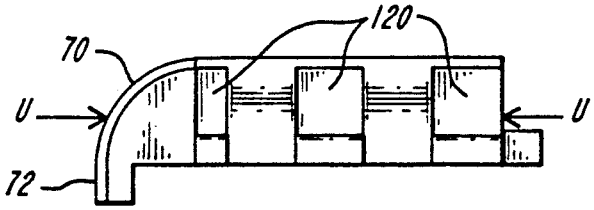
FIG. 4C is a side elevation view of the adaptor shown in FIG. 4.
Figure 4:
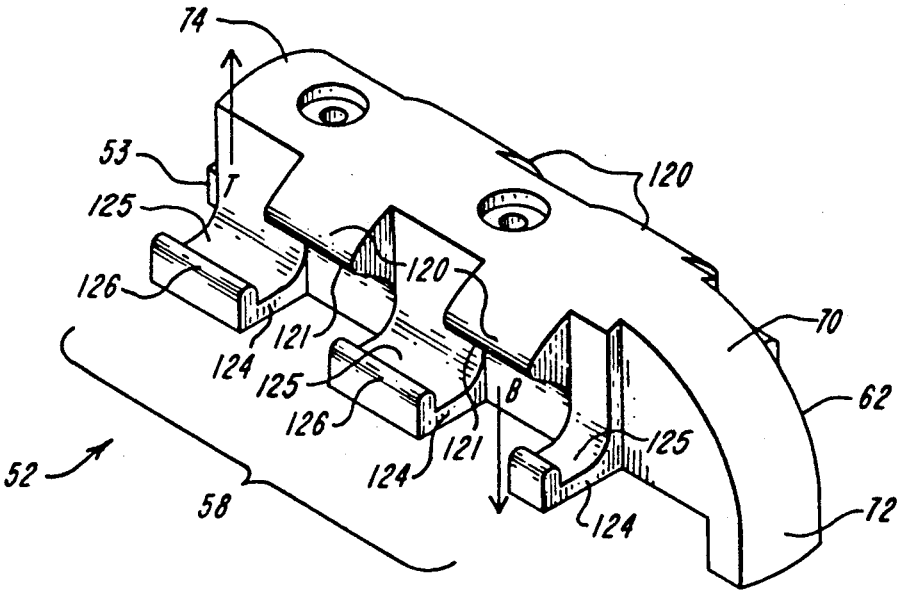
FIG. 4 is a perspective view of the adaptor piece of the claimed invention.
Figure 5:
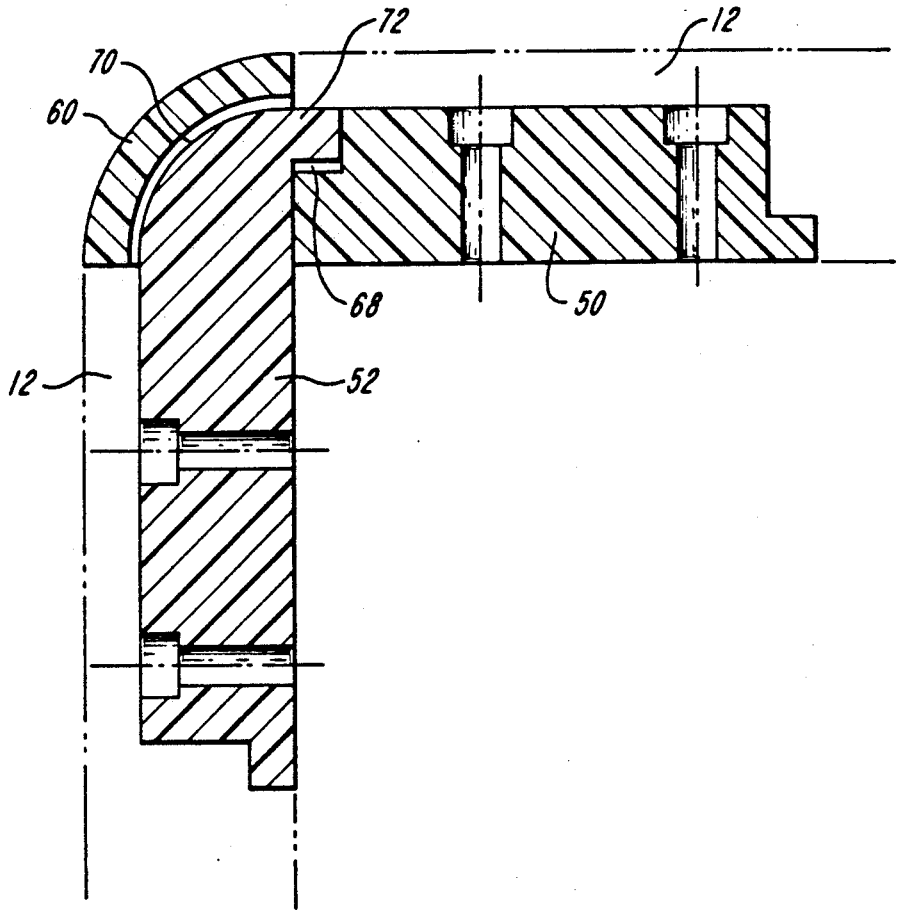
FIG. 5 is a plan view, shown in cross-section of an assembled corner assembly.

As will be understood from reference to FIG. 6, the receptacle 64 and lock extension 68 of corner piece 50 are designed to mate with corresponding parts of adaptor member 52, shown in more detail in FIG. 4. Curved tongue 70 is sized and shaped to fit within the receptacle 64 of corner piece 50. Tongue 70 is approximately in the shape of a quarter of a disc and has a tongue projection 72 sized and shaped to lock into hollow lock extension 68. Adaptor 52, in addition to head portion 62, is also provided with a mounting portion shown generally at braces 58.

Curved tongue 70 engages receptacle 64 by positively locking within it. By "positive locking," it is meant that a force additional to a frictional force retains the tongue within the receptacle 64. Withdrawal of the tongue 70 away from the receptacle 64 in a direction parallel to the long axis of the adaptor is blocked by the positive locking of the tongue projection 72 within the lock extension 68.

Referring again to FIG. 6, the means by which the mounting portions 56 and 58 of corner 50 and adaptor 52 respectively engage the resilient strip 12 will be reviewed. As is shown in FIG. 1, radially inward latch member 16 of resilient strip 12 is captured between latch members 26 and 20 of channel member 10. Theoretically, it would be possible to fabricate the channel mounting portions 56 and 58 in the same configuration as is channel mounting member 10. However, for reasons that will be discussed below, it is advantageous that corner assembly pieces 50 and 52 be fabricated from vinyl, rather than that they be of extruded metal or plastic, such as channel mounting member 10. When making extruded shapes, it is possible for the shape to have a reentrant cross-section, i.e. one with a large internal recess and a narrow gap at the entrance to the recess, similar to a well protected harbor with a narrow harbor entrance. Such a configuration is present in the channel mounting member, the recess being bounded by web portion 18, leg 22, base member 24 and base latch portion 26. An extrusion die is simply cut with that shape and the material is extruded through the die.

However, it would not be possible to make a simple two-piece mold to fabricate such a piece. The reason is that the portion of the mold that will form the recess would be larger than the neck at the entrance to the recess, and thus, it would be impossible to withdraw the mold from the molded part once the molded part hardened.

This manufacturing concern can be illustrated with reference to FIG. 4. The piece of FIG. 4 is fabricated from a two-piece mold, one mold suitable to form the shape above the line UU, and one mold suitable to form the shape below the line. Mounting portion 58 of adaptor 52 is comprised of a body 74 and symmetrical base members 124 and wedge latch portions 120 extending away therefrom. As will be understood from reference to FIG. 4B, wedge latch portions 120 are longitudinally discontinuous, and each have a face 121 that lies on a surface generally parallel the long axis of adaptor 52. Base members 124 are likewise discontinuous and each have a face 125 that lies on a similar surface. The two surfaces define channels 116 capable of engaging radially inwardly extending latch member 16 of resilient strip 12, despite the fact that wedge latch portions 120 and base members 124 are longitudinally discontinuous. The base members 124 are staggered with respect to the latch portions 120, so that a free space occupies the portion of the channel opposite each base member 124 and latch portion 120.

Due to the staggered, longitudinal discontinuity, it is possible to fabricate the elements 50 and 52 from a two-piece mold. With a two-piece mold, it is possible to withdraw the molds in the directions of arrows T and B of FIG. 4 without the mold removal being hindered by any portion of the molded part.

The structure of the corner piece 50 is identical with respect to the mounting portions to the construction of the adaptor piece 52.

The mode of installation of the corner assembly of the invention will be readily understood to one of ordinary skill in the art. First, corner piece 50 and adaptor 52 are engaged by inserting adaptor tongue 62 into corner receptacle 64 and locking the two together. The assembled corner/adaptor assembly is attached to the surface of the structure 14 which it is meant to protect, using screws through holes 54. Either before or after corner pieces 50, 52 are attached, the resilient member 12 can be engaged to the mounting member 10 by pressing the inwardly extending latch member 16 into the cavity formed between the latch extension 26 and web latch extension 20 of the channel member 10, and the channel 116 formed by web latch portions 120 and base latch extensions 126.

Figure 2:
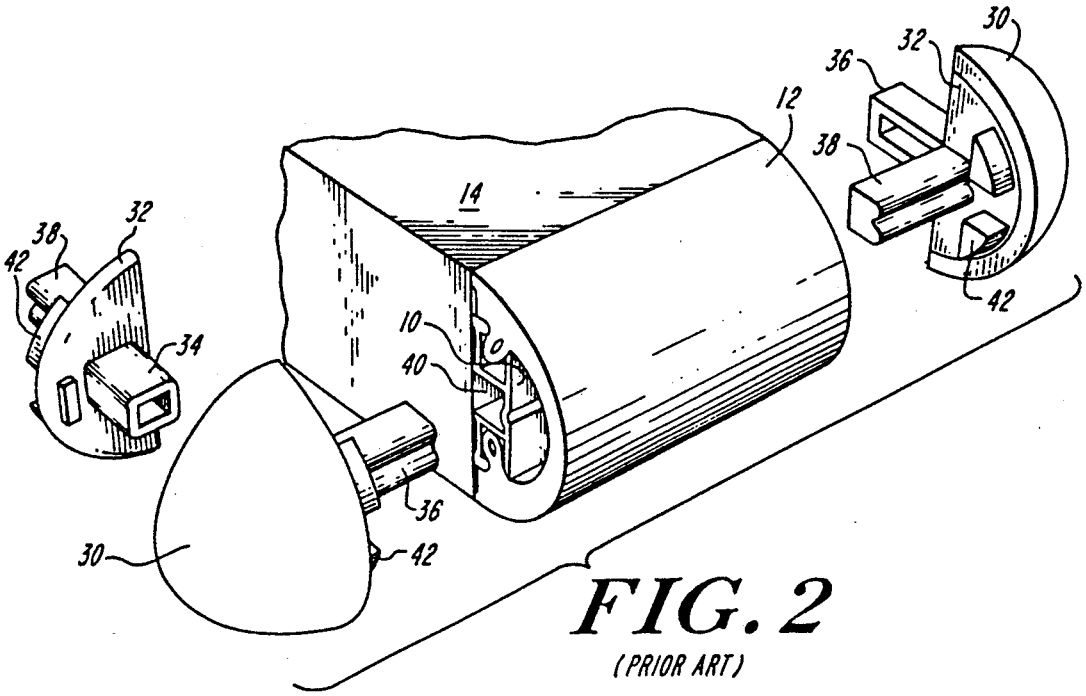
FIG. 2 (PRIOR ART)
FIG. 2 is a perspective view of a combined resilient strip and mounting member in conjunction with a corner assembly of the prior art, shown exploded and assembled.

It should be noted that, unlike the corner assembly of the prior art (FIG. 2) the instant invention is unlikely to be inadvertently installed without deployment of screws 54. This is because there are no elements analogous to tangs 36, 38 of the prior art that would support the corner assembly without screws. A pair of short tabs 57 on corner 50 and 53 on adaptor 52 are provided to help center the corner assembly of the invention with respect to the mounting channel 10, however, they are not long enough to support the weight of the two piece assembly.

Before the resilient member 12 is inserted into channel 116, an adhesive can be applied to the corner 50 and adaptor 52 and the inner portion of resilient member 12. This prevents resilient member 12 from pulling away from the corner as it shrinks due to relaxation of the stresses of installation, and as a result of aging.

The foregoing discussion should be taken as illustrative and not limiting in any sense. For instance, it is not necessary that the corner pieces be made of vinyl. They may be made of a harder plastic, or of any other suitably durable and resilient material. It is also not necessary that the tongue and receptacle shapes be maintained exactly as shown. Any positively engaging mating shapes are within the bounds of the claimed invention.

Having described the invention, what is claimed is:

1. A corner assembly for use with a flush fitting protective strip bumper comprising:

a. a corner piece having an elongate mounting portion, which terminates in a head portion having a receptacle and;

b. an adaptor piece, having an elongate mounting portion, which terminates in a corner engagement portion having a tongue;

c. wherein said tongue pivotably positively engages with said receptacle.

2. The corner assembly of claim 1, said engaging means comprising means for engaging said corner portion and said adaptor portion such that said mounting portions of each are perpendicular to each other.

3. The corner assembly of claim 1, said head portion of said corner piece comprising a quarter sphere.

4. The corner assembly of claim 1, said elongate mounting portions of each said corner piece and said adaptor comprising:

a pair of channels, each channel having a pair of discontinuous channel surfaces, each surface staggered with respect to the other surface of the pair, wherein said channels extend symmetrically from opposite sides of said body portion.

5. The corner assembly of claim 1, said mounting portions of said corner piece and said adaptor piece shaped to retain said protective strip.

6. The corner assembly of claim 1, said corner piece and said adaptor piece comprising a molded material.

7. The corner assembly of claim 6, said corner piece and said adaptor comprising vinyl.

8. A corner assembly for use with a flush fitting protective strip bumper comprising:

a. a corner piece having an elongate mounting portion which terminates in a head portion having a unitary receptacle in the form of a quarter of a disk with a tangentially extending lock extension;

b. an adaptor piece, having an elongate mounting portion which terminates in a corner engagement portion having a unitary tongue in the form of a quarter of a disk with a tangentially extending tongue projection;

wherein said tongue projection positively engages with said lock extension of said receptacle, positively engaging said corner engagement portion to said head portion.

* * * * *